US008904906B2

(12) United States Patent
Adams et al.

(10) Patent No.: US 8,904,906 B2
(45) Date of Patent: Dec. 9, 2014

(54) WRENCH

(76) Inventors: Stephen Adams, Merced, CA (US); Frank Baer, Merced, CA (US)

( * ) Notice: Subject to any disclaimer, the term of this patent is extended or adjusted under 35 U.S.C. 154(b) by 603 days.

(21) Appl. No.: 13/135,717

(22) Filed: Jul. 12, 2011

(65) Prior Publication Data

US 2013/0014613 A1 Jan. 17, 2013

(51) Int. Cl.

| | |
|---|---|
| ***B25B 13/46*** | (2006.01) |
| ***B25B 17/02*** | (2006.01) |
| *B25B 23/00* | (2006.01) |
| *B25B 13/48* | (2006.01) |

(52) U.S. Cl.

CPC ..... *B25B 13/463* (2013.01); *B25B 23/0035* (2013.01); *B25B 17/02* (2013.01); *B25B 13/46* (2013.01); *B25B 13/481* (2013.01)

USPC ..... 81/57.3; 81/63.2

(58) Field of Classification Search

CPC ..... B25B 17/00; B25B 13/46

USPC ..... 81/57.3, 63.2

See application file for complete search history.

(56) References Cited

U.S. PATENT DOCUMENTS

| | | | | |
|---|---|---|---|---|
| 2,520,443 | A * | 8/1950 | Seaquist | 475/3 |
| 2,680,983 | A | 6/1954 | Miller | |
| 3,828,629 | A | 8/1974 | Moore | |
| 3,983,759 | A | 10/1976 | Linden | |
| 4,366,731 | A | 1/1983 | Vallevand | |
| 5,009,132 | A | 4/1991 | Gilberto | |
| 6,257,097 | B1 | 7/2001 | I-He | |
| 6,314,839 | B1 * | 11/2001 | Carter | 81/63 |
| 7,168,340 | B1 | 1/2007 | Green | |
| 7,536,934 | B1 | 5/2009 | Tatangelo | |
| 2003/0213341 | A1 | 11/2003 | Alden | |

* cited by examiner

*Primary Examiner* — Monica Carter
*Assistant Examiner* — Danny Hong
(74) *Attorney, Agent, or Firm* — James E. Brunton

(57) ABSTRACT

A wrench for rotating a drive member such as a socket, the wrench having a housing including a head portion and a handle portion, the head portion having an inner peripheral wall defining an internal cavity; a set of drive teeth circumscribing the inner peripheral wall of the head portion of the housing and extending into the internal cavity; a drive gear disposed within the internal cavity of the head portion of the housing; a socket engaging drive member connected to the drive gear and extending outwardly from the head portion of the housing; a set of opposition gears disposed within the internal cavity of the head portion of the housing, the opposition gears being disposed between and interconnected with the drive gear and the drive teeth; and an operating assembly carried by the housing and operably associated with the drive gear, the operating assembly including a novel quick turn mechanism for controllably changing the operating mode of the wrench from a tightening mode to a loosening mode.

11 Claims, 8 Drawing Sheets

WRENCH

CROSS-REFERENCE TO RELATED APPLICATIONS

Not Applicable

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

BACKGROUND OF THE INVENTION

1. Field of the Invention

The present invention relates generally to wrenches. More particularly, the invention concerns a ratchet wrench that provides constant drive to the output of the wrench upon rotational movement of the wrench handle in either direction.

2. Description of Related Art Including Information Disclosed Under 37 CFR 1.97 and 1.98

Ratchet type wrenches are well known in the prior art. These types of wrenches function to apply force or torque to a nut or bolt without having to remove or replace the wrench at the end of each force-applying movement. Typically, such wrenches are used in conjunction with sockets configured for a particular nut or bolt size. While the typical prior art ratchet type wrenches provide for an acceleration of the work effort, they also exhibit an associated lost motion. More particularly, rotational movement of the wrench in one direction applies force, but during the return rotational movement no force is applied thereby resulting in wasted motion.

In the past, several attempts have been made to design ratchet wrenches that allow for drive during both the forward and return strokes of the ratchet handle. However, as a general rule, these past attempts have produced wrenches that are unduly complex, are difficult to use and are quite expensive to produce. Exemplary of these previous attempts are the prior art wrenches illustrated and described in the following patents:

Prior art U.S. Pat. No. 7,168,340 issued to Green describes a ratchet wrench in which a combination ring gear, sun gear and planetary gear system is used in combination with a drive pawl arrangement to achieve power drive in both directions of operation. Accelerated speed of operation is attained upon the return stroke as a function of gear sizing. In other embodiments, the planetary gear system is replaced with an intermediate gear assembly external to and inter-engaging both a drive and driven gear.

In the prior art patent issued to Gilberto, U.S. Pat. No. 5,009,132, a device in the nature of a wrench or the like is described in which reciprocatory rotary motion is converted to continuous rotation in one direction. The Gilberto device comprises first and second outer housings located in spaced relationship, a third intermediate housing lying between and joining the first and second housings, the intermediate housing having means for rotating it about a main axis, a ring lying within the intermediate housing and rotatable therein about the said main axis, the ring being formed with ratchet teeth on its outer periphery and with gear teeth on its inner periphery, a cluster of planetary gears carried within the ring and engaging the gear teeth of the ring, and a sun gear located within the cluster for rotation about the main axis and extending axially into engagement with both the first and second housings.

BRIEF SUMMARY OF THE INVENTION

By way of brief summary, one form of the wrench of the present invention comprises a housing including a head portion and a handle portion, the head portion having an inner peripheral wall defining an internal cavity; a set of drive teeth circumscribing the inner peripheral wall of the head portion of the housing and extending into the internal cavity; a drive gear disposed within the internal cavity of the head portion of the housing and interconnected with the drive teeth; a socket engaging drive member connected to the drive gear and extending outwardly from the head portion of the housing; a set of opposition gears disposed within the internal cavity of the head portion of the housing, the opposition gears being disposed between and interconnected with the drive gear and the drive teeth; and an operating assembly carried by the housing and operably associated with the drive gear, the operating assembly comprising a drive rod having a first end and a second end; a torque guide connected to the first end of the drive rod, the torque guide being movable from a first position in engagement with the drive gear to a second position; and a quick turn mechanism rotatably connected to the second end of the drive rod and operably associated with the torque guide for moving the torque guide between the first and second positions.

With the foregoing in mind, it is an object of the present invention to provide a ratchet wrench that provides constant drive to the output of the wrench upon rotational movement of the wrench handle in either direction.

Another object of the invention is to provide a ratchet wrench of the aforementioned character in which a swinging motion of the wrench handle produces continuous rotation of the output of the wrench in a desired direction.

Another object of the invention is to provide a ratchet wrench of the character described which includes a novel operating assembly carried by the housing and operably associated with the drive gear, the operating assembly functioning to controllably change the operating mode of the wrench from a tightening mode to a loosening mode.

Another object of the invention is to provide a ratchet wrench of the character described in the preceding paragraph in which the operating assembly comprises a drive rod having a first end and a second end; a torque guide connected to the first end of the drive rod, the torque guide being movable from a first position in engagement with the drive gear to a second position; and a quick turn mechanism rotatably connected to the second end of the drive rod and operably associated with the torque guide for moving the torque guide between the first and second positions.

Another object of the invention as described in the preceding paragraphs is to provide a wrench in which the operating assembly permits conversion between tightening and loosening from the end of the wrench handles eliminating reaching to the head of the wrench or removal of nut-like fastener.

Another object of the invention is to provide a wrench of the character described in the preceding paragraphs which is of a simple construction, is easy to use, requires a minimum of maintenance, and one which can be manufactured inexpensively.

The foregoing as well as other objectives of the invention is achieved by the novel wrench illustrated in the attached drawings and described in the paragraphs which follow.

DETAILED DESCRIPTION OF THE INVENTION

Figure 1:
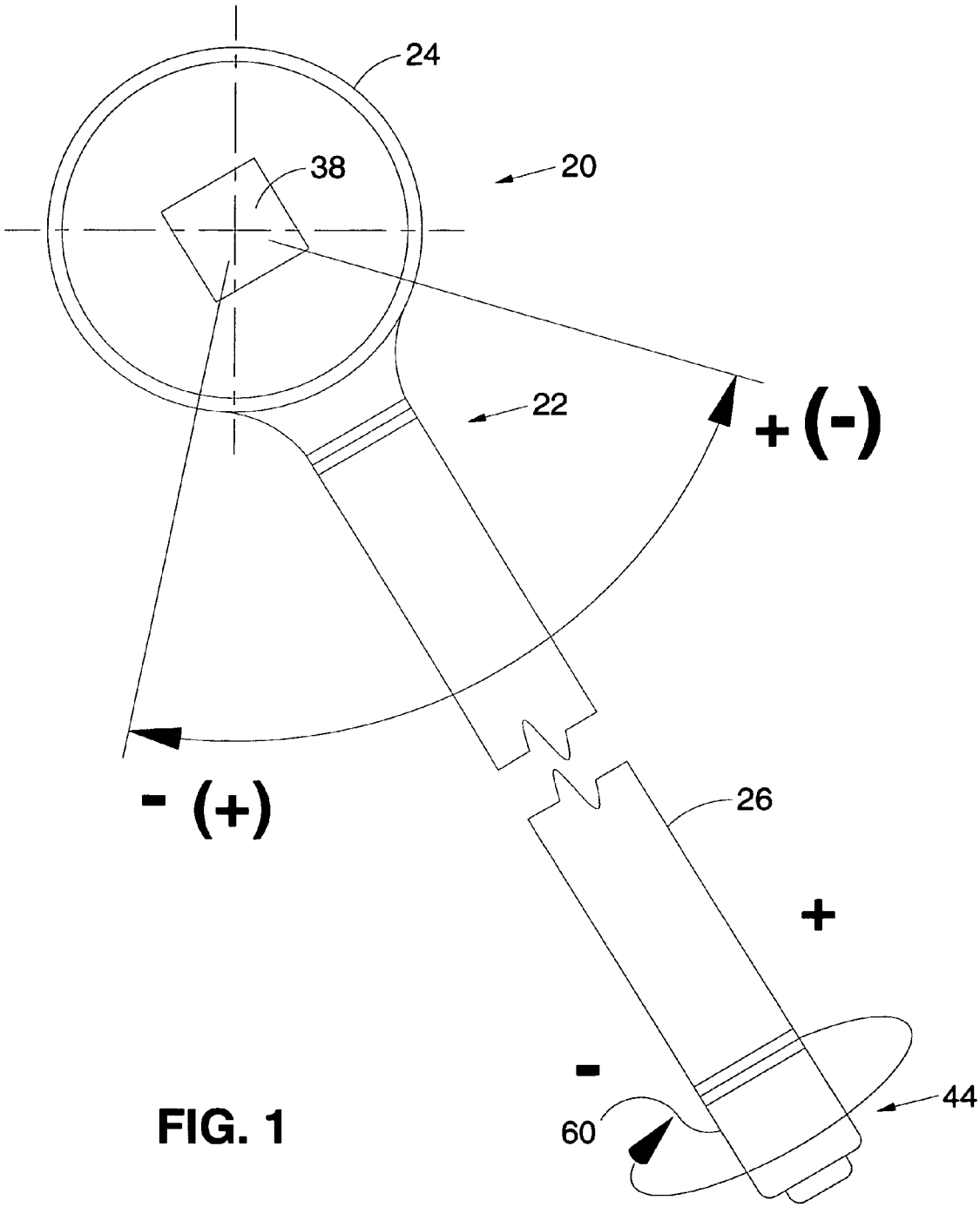
FIG. 1 is a foreshortened top plan, illustrative view of one form of the wrench of the present invention.
Figure 2:
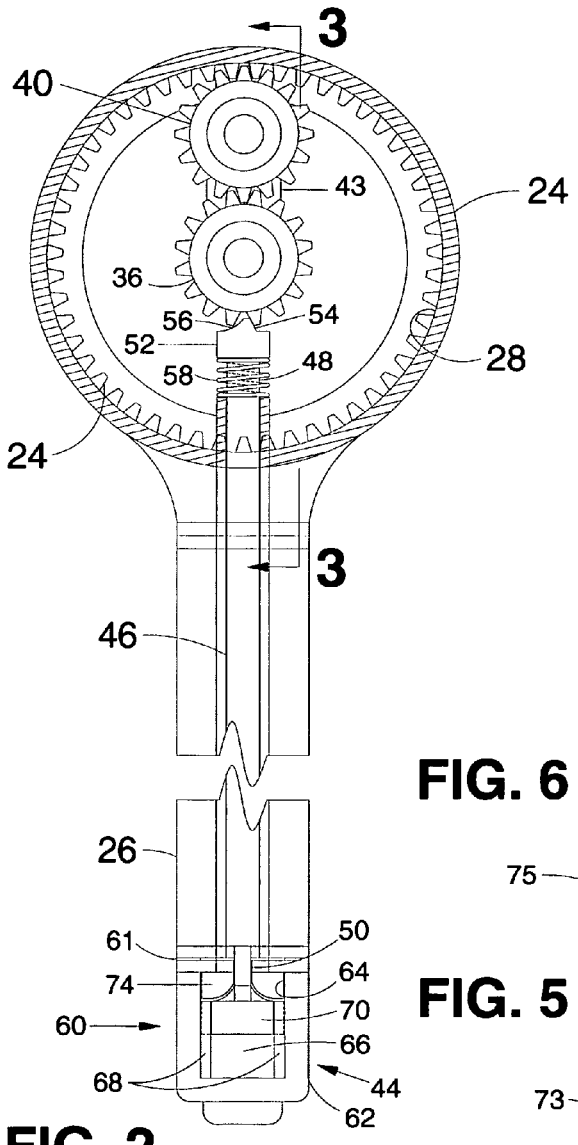
FIG. 2 is a foreshortened view partially in cross-section and a partially broken away to show internal construction of the wrench shown in FIG. 1 of the drawings.
Figure 3:
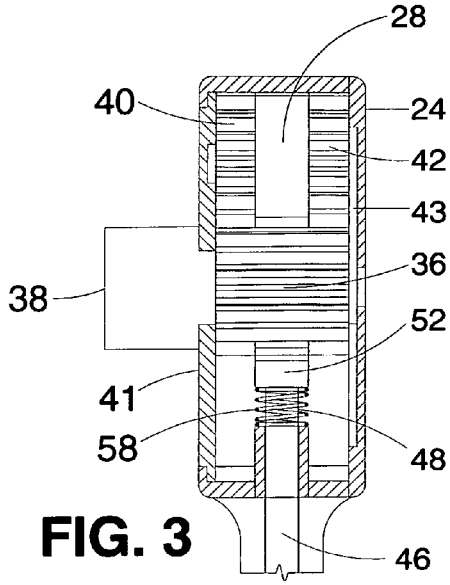
FIG. 3 is a cross-sectional view taken along lines 3-3 of FIG. 2.
Figure 8:
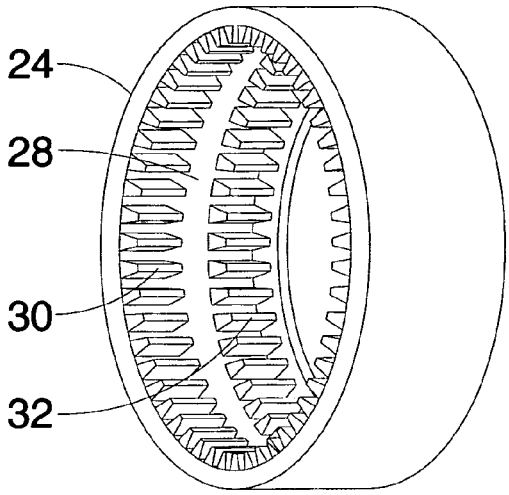
FIG. 8 is a generally perspective view of the head portion of the wrench housing.
Figure 7:
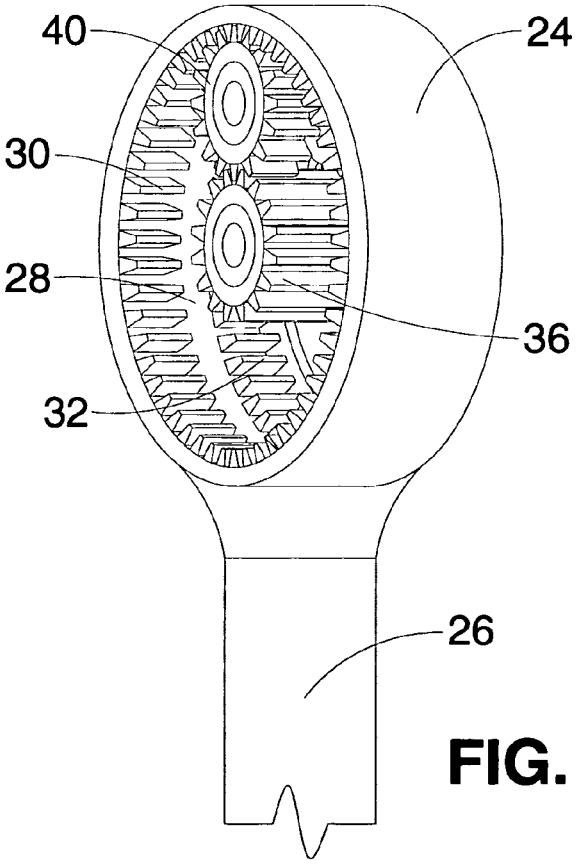
FIG. 7 is a generally perspective, fragmentary view of the upper portion of the wrench of the invention partly broken away to show internal construction.

Referring to the drawings and particularly to FIGS. 1 through 7, one form of the wrench of the present invention is there shown and generally designated by the numeral 20. This form of the wrench construction here comprises a housing 22 that includes a head portion 24 and a handle portion 26. As best seen in FIGS. 2 and 3, head portion 24 has an inner peripheral wall 28 that defines an internal cavity 28. A first set of drive teeth 30 circumscribes the inner peripheral wall 28 and a second set of transversely spaced apart drive teeth 32 circumscribes the inner peripheral wall (see FIGS. 7 and 8). Disposed within internal cavity 28 is a drive gear 36 that is connected to and spans the first and second opposition gears, the character of which will presently be described. As illustrated in FIGS. 3, 3A, 3B, 3C and 3D, a socket engaging drive member 38 is connected to a face plate 41 that is, in turn, connected to drive gear 3. Drive member 38 extends outwardly from face plate 41 which forms a part of head portion 24.

Figure 9:
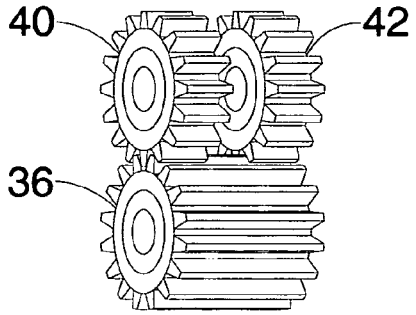
FIG. 9 is a generally perspective view of the drive gear and opposition gears of the wrench.

Also disposed within internal cavity 28 are first and second opposition gears 40 and 42. As depicted in FIG. 3 of the drawings, opposition gears 40 and 42 are disposed between drive gear 36 and the first and second sets of transversely spaced apart drive teeth 30 and 32. More particularly, opposition gear 40 is connected to and spans drive teeth 30 and gear 36, while opposition gear 42 is connected to and spans drive teeth 32 and gear 36 (see also FIG. 9). Drive gear 36 is connected to opposition gear by a connector plate 43 (see FIGS. 3A, 3B, 3C and 3D).

Figure 6:
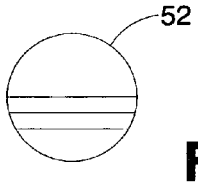
FIG. 6 is a top plan view of the torque guide of the operating assembly of the wrench.
Figure 6A:
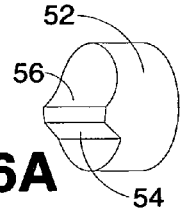
FIG. 6A is a generally perspective view of the torque guide.
Figure 12:
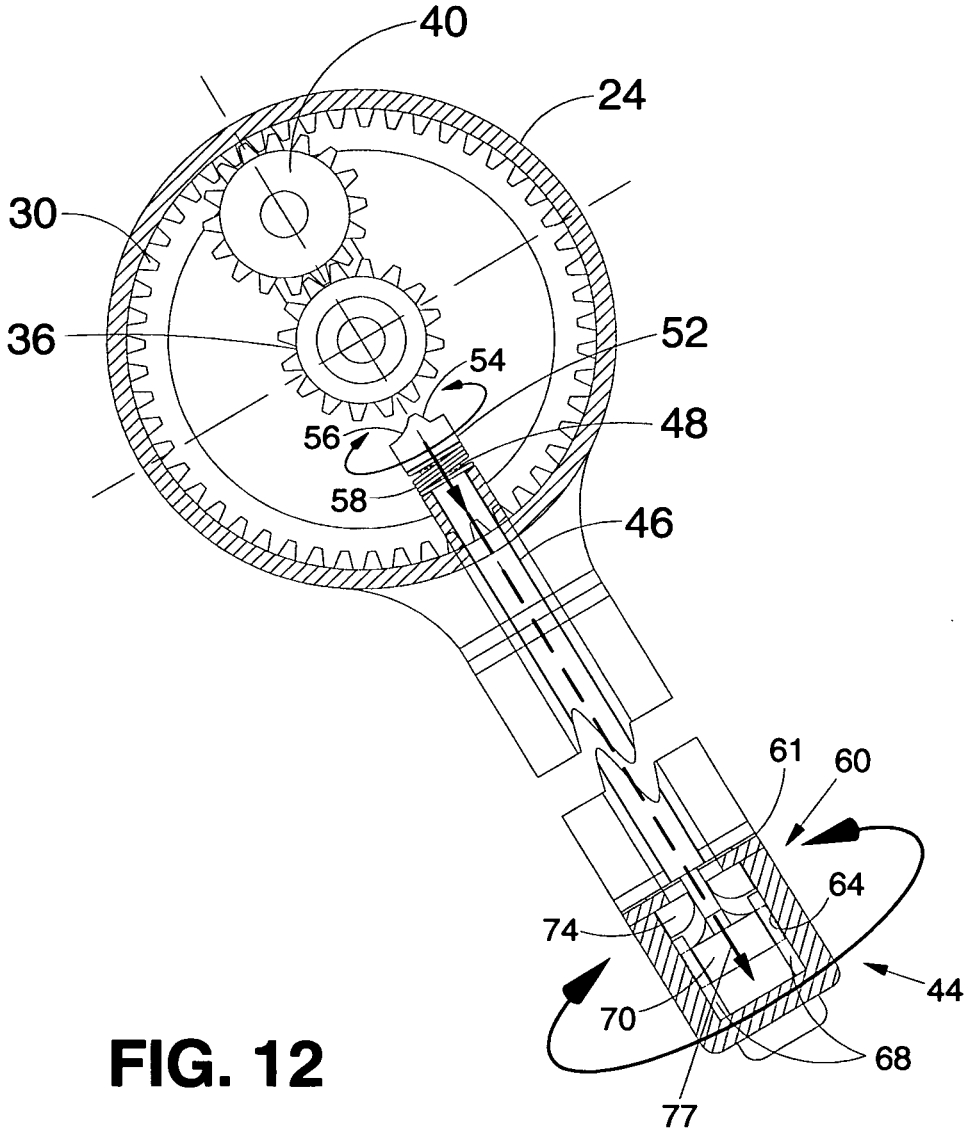
FIG. 12 is a view similar to FIG. 10, but illustrating the operation of the quick turn mechanism of the invention to move the torque guide from the first position shown in FIG. 10 to a position wherein the torque guide is spaced apart from the drive gear.

Forming an important feature of the wrench of the invention is a novel operating assembly 44 that is carried by housing 22 and, in a manner presently to be described, is operably associated with drive gear 36. Operating assembly 44 here comprises an elongate drive rod 46 that has a first end 48 that is disposed within head portion 24 and a second end 50 that is disposed within handle portion 26. Connected to the first end of the drive rod is a uniquely configured torque guide 52 that is movable from a first position in engagement with the drive gear 36 (see FIG. 10) to a second position wherein it is spaced apart from the drive gear (see FIG. 12). For a purpose presently to be described, torque guide 52 has a shoulder 54 and an adjacent tapered wall 56 (see FIGS. 2 and 6A). Shoulder 54 is constructed, and in one mode of operation of the wrench is arranged, to engage the drive gear in a manner to prevent its rotation. A biasing spring 58, which is carried by the first end 48 of the drive rod, functions to continuously urge torque guide 52 into locking engagement with the drive gear (see FIGS. 2 and 10). The torque guide provides either locked or ratchet operation. In the locked position it holds the drive gear stationary, providing operation of the wrench within the loosening or tightening direction. In the ratcheting direction it allows movement of the drive gear and the opposition gears to allow continued operation of the wrench in the opposing direction. The biasing spring 58 provides pressure against the drive gear to maintain it in the selected position.

Figure 10:
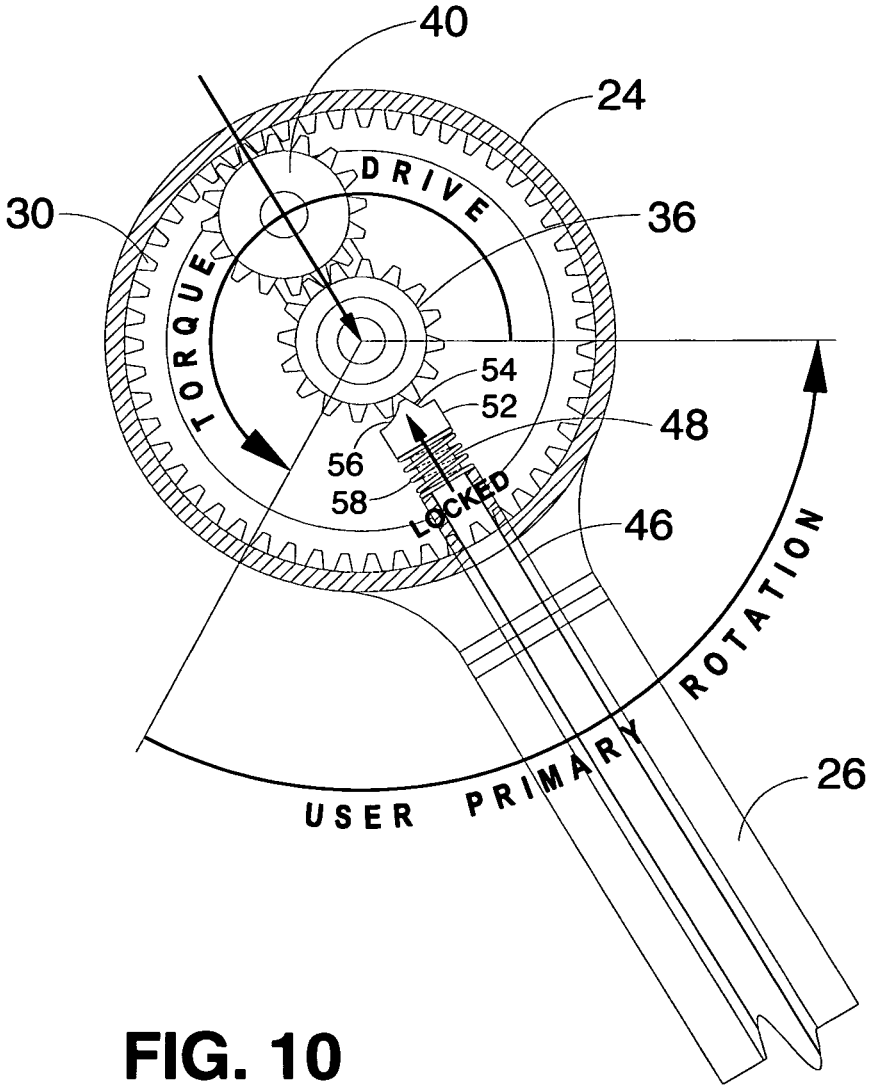
FIG. 10 is an illustrative, fragmentary top plan view similar to FIG. 2, illustrating the relative movement of the component parts of the wrench during the primary rotation of the wrench by the user.
Figure 11:
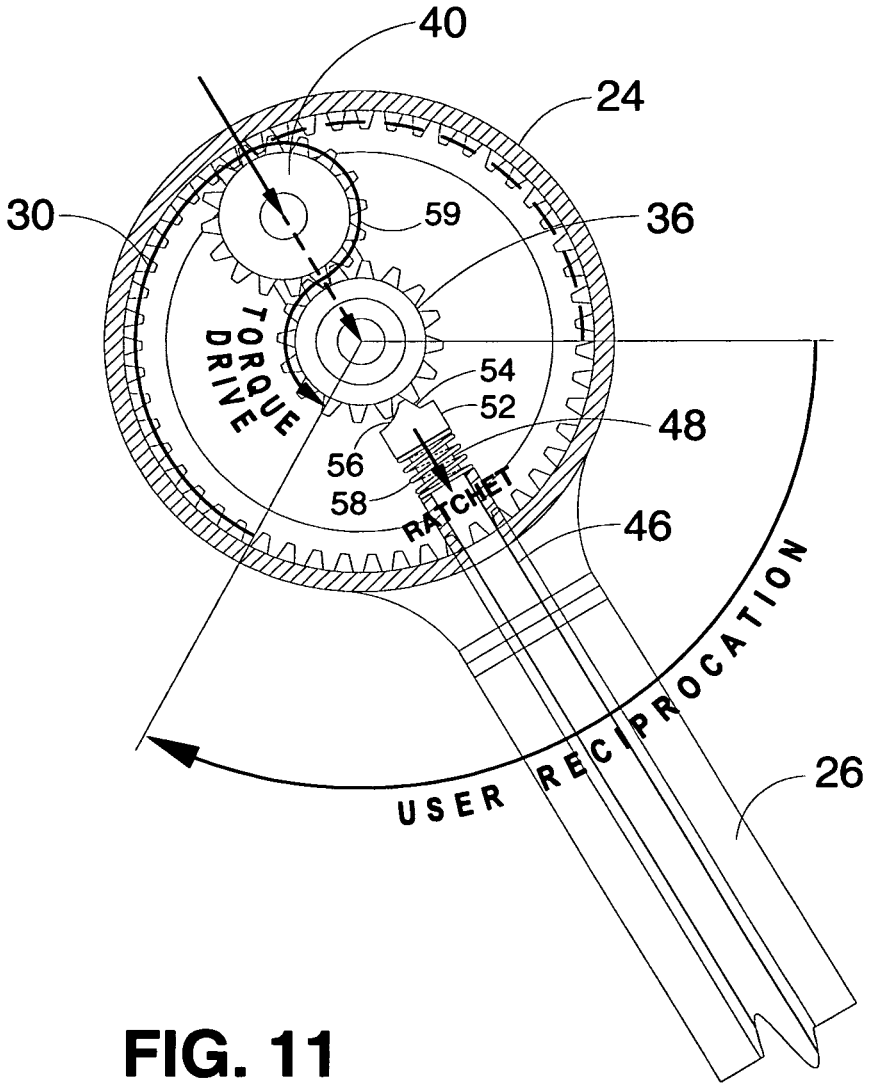
FIG. 11 is an illustrative, fragmentary top plan view similar to FIG. 10, illustrating the relative movement of the component parts of the wrench during the reciprocation operation of the wrench by the user.

As illustrated in FIG. 10, counter clockwise rotation of the handle 26 in the user primary, or tightening rotation, causes opposition gears 40 and 42 to rotate in a counter clockwise direction and causes drive gear 36 to rotate in a clockwise direction. Because the teeth of the drive gear engage locking shoulder 54 of the torque guide in the manner depicted in FIG. 10, continued rotation of the handle in the primary rotation direction shown in FIG. 10 will cause the face plate 41 and the socket engaging drive member 38 to rotate in a tightening direction. As illustrated in FIG. 11, and as indicated by the arrow 59, clockwise rotation of the handle 26 in the user reciprocation direction, causes opposition gears 40 and 42 to rotate in a clockwise direction and causes drive gear 36 to rotate in a counter-clockwise direction. Because the teeth of the drive gear engage the tapered surface 56 of the torque guide in the manner depicted in FIG. 11, continued rotation of the handle in the direction shown in FIG. 11 will cause the drive gear to ratchet and will cause the socket engaging drive member 38 to continue to rotate in a tightening direction.

Also forming an important part of the operating assembly 44 is a quick turn mechanism 60 that extends from handle portion 26 and houses the components for changing the directional orientation of the ratchet mechanics of the wrench between tightening and loosening. It is gripped by the ratchet user and rotated in either direction to allow quick changing of the ratchet operation. The interface between handle portion 26 and the quick turn mechanism comprises a slide washer 61 that allows for smooth rotation of the quick turn mechanism by the user.

More particularly, as will be discussed in greater detail in the paragraphs which follow, quick turn mechanism 60, which is operably associated with torque guide 52, functions to controllably change the operating mode of the wrench from a tightening mode to a loosening mode. As will presently be described, in changing the operating mode of the wrench, mechanism 60 controllably moves the torque guide between the first position shown in FIGS. 2 and 11 and the second position shown in FIGS. 12 and 13.

Figure 4:
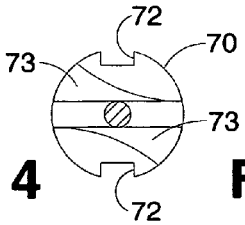
FIG. 4 is a top plan view of the direction actuator of the quick turn mechanism of the operating assembly of the wrench.
Figure 4A:
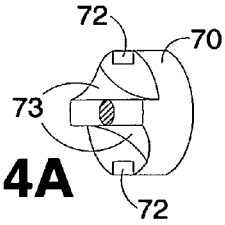
FIG. 4A is a generally perspective view of the direction actuator of the quick turn mechanism of the operating assembly of the wrench.
Figure 3A:
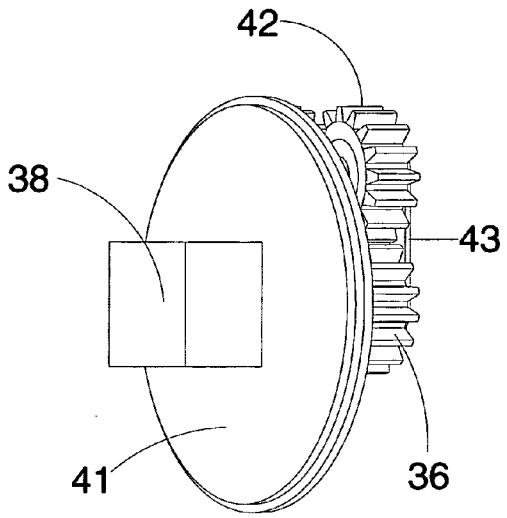
FIG. 3A is a generally perspective fragmenting front view of a portion of the head portion of the wrench illustrating the construction of the drive sub-assembly of the wrench that comprises the face plate, drive gear, socket-engaging member, and opposition gears.
Figure 3C:
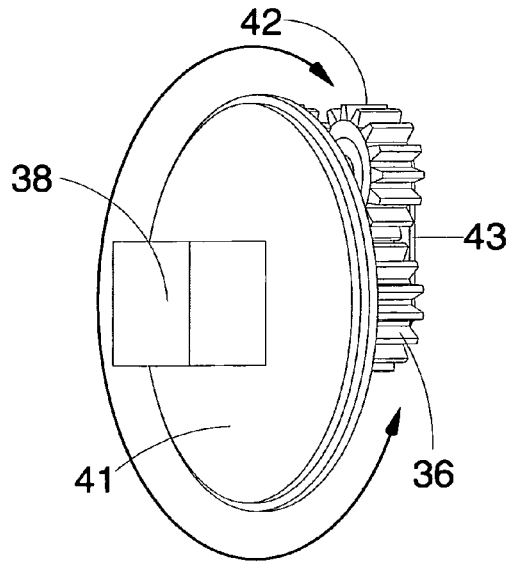
FIG. 3C is a view similar to FIG. 3A showing the direction of rotation of the face plate.
Figure 3B:
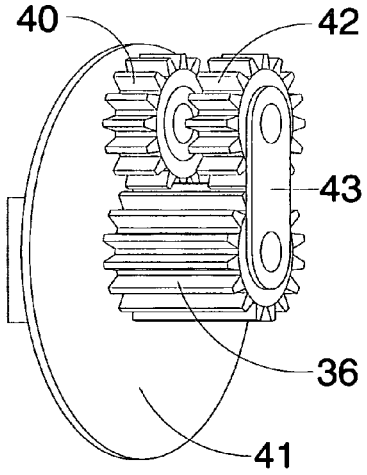
FIG. 3B is a generally perspective, fragmentary rear view of the drive sub-assembly shown in FIG. 3A.
Figure 3D:
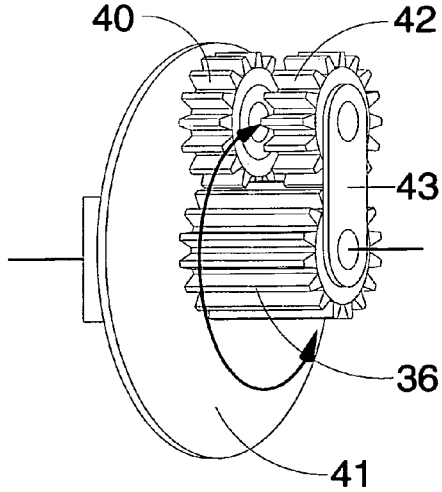
FIG. 3D is a view similar to FIG. 3B showing the direction of rotation of the drive gear and the opposition gears.

As illustrated in FIGS. 2 through 6A, the quick turn mechanism 60 of the operating assembly here comprises a grip housing 62 having an internal wall 64 defining an internal cavity 66 and a pair of spaced apart keys 68 that are connected to internal wall 64 and extend into cavity 66. Also forming a part of the quick turn mechanism 60 is a uniquely configured direction actuator 70 that is mounted within internal cavity 66 and is provided with a pair of transversely spaced apart keyways 72 (FIGS. 4 and 4A). Keyways 72 are constructed and arranged to slidably engage the keys 68 of grip housing 62 to permit the direction actuator to move within internal cavity 66 between the first position shown in FIG. 2 and the second position shown in FIG. 12. As illustrated in FIG. 4A, direction actuator 70 is provided with a novel, convex cam face 73.

Also forming a part of the quick turn mechanism 60 is a uniquely configured direction lock 74 that is mounted within internal cavity 66 in a stationary manner and is connected to the grip housing. Direction lock 74, which is operably associated with direction actuator 70, functions to move the direction actuator between the first and second positions upon rotation of the grip housing 62.

Figure 5:
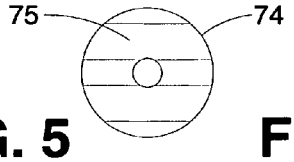
FIG. 5 is a top plan view of the locking member of the quick turn mechanism of the operating assembly of the wrench.
Figure 5A:
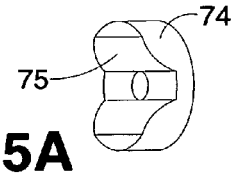
FIG. 5A is a generally perspective view of the locking member of the quick turn mechanism of the operating assembly of the wrench.

In a manner presently to be described, direction lock 74 functions to maintain the wrench in the selected tightening, or loosening mode. As illustrated in FIGS. 5 and 5A, direction actuator 70 is provided with a novel, concave cam face 75 that interfaces with convex cam face 73 in the manner depicted in FIGS. 2 and 12. The direction actuator 70 is a sliding component that interfaces with the end of the ratchet handle and the stationary direction lock 74. The novel design of the direction actuator 70 provides slip operation from its position with the direction lock 74 into 180 degree increments, aligned with the torque guide 52 and the drive gear 36.

In using the operating assembly of the invention, rotation of the grip housing 62 by the user causes concomitant rotation of the direction actuator 70 and the drive rod. As the direction actuator 70 rotates, the concave cam face 75 of the direction lock interfaces with the convex cam face 73 of the direction actuator 70 causing the direction actuator to move along the keys 68 in the direction of the arrow 77 of FIG. 12. This movement of the direction actuator causes the torque guide to be pulled away from the drive gear and rotated 180 degrees. This uniquely realigns the operation of the wrench from the previous tightening direction into the loosening direction shown in FIG. 13 of the drawings. Once enough rotation of the grip housing 62 has occurred, the torque guide 52 will be locked into place due to the force of the spring 58.

Figure 13:
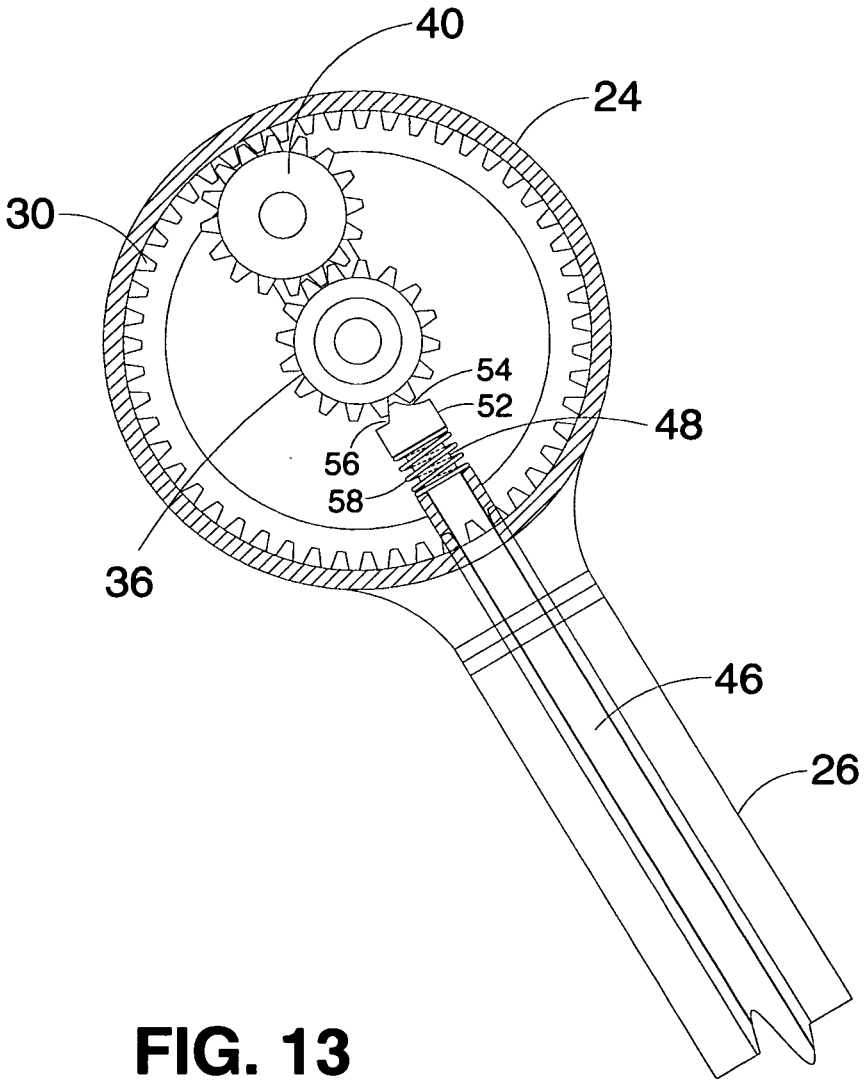
FIG. 13 is a view similar to FIG. 10, but showing the torque guide moved by the quick turn mechanism from the first tightening position shown in FIGS. 10 and 11 into a second loosening position.

With the torque guide 52 in the position illustrated in FIG. 13, rotation of the handle 26 in a counter-clockwise direction causes opposition gears 40 and 42 to rotate in a counter clockwise direction and causes drive gear 36 to rotate in a clockwise direction. Because the teeth of the drive gear engage the tapered surface 56 of the torque guide in the manner depicted in FIG. 13, continued rotation of the handle in the counter clockwise direction will cause the drive gear to ratchet and will cause the socket engaging drive member 38 to continue to rotate in a loosening direction. Rotation of the handle 26 in a clockwise direction causes opposition gears 40 and 42 to rotate in a clockwise direction and causes drive gear 36 to rotate in a counter-clockwise direction. Because the teeth of the drive gear engage locking shoulder 54 of the torque guide in the manner depicted in FIG. 13, continued rotation of the handle in the clockwise direction will cause the socket engaging drive member 38 to continue to rotate in a loosening direction.

It is to be observed that during operation of the wrench in both the tightening and loosening mode, the torque guide 52, the biasing spring 58, and a portion of the rod 46 pass between the opposition gears 40 and 42 allowing rotation along the drive teeth throughout an angle of 360 degrees.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

The invention claimed is:

1. A wrench for rotating a socket comprising:

(a) a housing including a head portion and a handle portion, said head portion having an inner peripheral wall defining an internal cavity, a first set of drive teeth circumscribing said inner peripheral wall of said head portion and a second set of transversely spaced apart drive teeth circumscribing said inner peripheral wall of said head portion;

(b) a drive gear disposed within said internal cavity of said head portion of said housing, said drive gear connected to and spanning said first and second sets of transversely spaced apart drive teeth;

(c) a socket engaging drive member connected to said drive gear and extending outwardly from said head portion of said housing;

(d) first and second transversely spaced apart opposition gears disposed within said internal cavity of said head portion of said housing, said first and second transversely spaced apart opposition gears being disposed between said drive gear and said first and second sets of transversely spaced apart drive teeth, said first set of opposition gears being connected to said first set of transversely spaced apart drive teeth and said second set of opposition gears being connected to said second set of transversely spaced apart drive teeth; and (e) an operating assembly carried by said housing and operably associated with said drive gear, said operating assembly comprising:

(i) a drive rod having a first end and a second end;

(ii) a torque guide connected to said first end of said drive rod, said torque guide being movable from a first position in engagement with said drive gear to a second position in engagement with said drive gear; and (iii) a quick turn mechanism rotatably connected to said second end of said drive rod and operably associated with said torque guide for moving said torque guide between said first and second positions, said quick turn mechanism comprising:

a. a grip housing having an internal wall defining an internal cavity and a pair of spaced apart keys connected to said internal wall and extending into said cavity;

b. a direction actuator mounted within said internal cavity of said grip housing, said direction actuator being connected to said second end of said drive rod and having a pair of spaced apart keyways constructed and arranged to slidably engage said spaced apart keys of said grip housing to permit said direction actuator to move within said internal cavity of said grip housing between first and second positions; and c. a locking member disposed within said internal cavity of said grip housing, said locking member being operably associated with said direction actuator for moving said direction actuator between said first and second positions upon rotation of said grip housing.

2. The wrench as defined in claim 1 in which said operating mechanism further includes a biasing spring connected to said drive rod for urging said torque guide into engagement with said drive gear.

3. The wrench as defined in claim 2 in which said torque guide includes a shoulder constructed and arranged to engage said drive gear in a manner to prevent rotation of said drive gear.

4. The wrench as defined in claim 2 in which said torque guide includes a tapered surface constructed and arranged to engage said drive gear in a manner to permit rotation of said drive gear.

5. A wrench for rotating a socket comprising:

(a) a housing including a head portion and a handle portion, said head portion having an inner peripheral wall defining an internal cavity;

(b) a set of drive teeth circumscribing said inner peripheral wall of said head portion of said housing and extending into said internal cavity;

(c) a drive gear disposed within said internal cavity of said head portion of said housing and interconnected with said set of drive teeth;

(d) a socket engaging drive member connected to said drive gear and extending outwardly from said head portion of said housing;

(e) a set of opposition gears disposed within said internal cavity of said head portion of said housing, said opposition gears being disposed between and interconnected with said drive gear and said drive teeth; and (f) an operating assembly carried by said housing and operably associated with said drive gear for controllably changing the operating mode of the wrench from a tightening mode to a loosening mode, said operating assembly comprising:

(i) a drive rod having a first end and a second end;

(ii) a torque guide connected to said first end of said drive rod, said torque guide being movable from a first position in engagement with said drive gear to a second position; and (iii) a quick turn mechanism rotatably connected to said second end of said drive rod and operably associated with said torque guide for moving said torque guide between said first and second positions, said quick turn mechanism of said operating assembly comprising:

a. a grip housing having an internal wall defining an internal cavity and a pair of spaced apart keys connected to said internal wall and extending into said cavity;

b. a direction actuator mounted within said internal cavity of said grip housing, said direction actuator being connected to said second end of said drive rod and having a pair of spaced apart keyways constructed and arranged to slidably engage said spaced apart keys of said grip housing to permit said direction actuator to move within said internal cavity of said grip housing between first and second positions; and c. a locking member disposed within said internal cavity of said grip housing, said locking member being operably associated with said direction actuator for moving said direction actuator between said first and second positions upon rotation of said grip housing.

6. A wrench for rotating a socket comprising:

(a) a housing including a head portion and a handle portion, said head portion having an inner peripheral wall defining an internal cavity;

(b) a set of drive teeth circumscribing said inner peripheral wall of said head portion of said housing and extending into said internal cavity;

(c) a drive gear disposed within said internal cavity of said head portion of said housing and interconnected with said set of drive teeth;

(d) a socket engaging drive member connected to said drive gear and extending outwardly from said head portion of said housing;

(e) a set of opposition gears disposed within said internal cavity of said head portion of said housing, said opposition gears being disposed between and interconnected with said drive gear and said drive teeth; and (f) an operating assembly carried by said housing and operably associated with said drive gear for controllably changing the operating mode of the wrench from a tightening mode to a loosening mode, said operating assembly comprising:

(i) a drive rod having a first end and a second end;

(ii) a torque guide connected to said first end of said drive rod, said torque guide being movable from a first position in engagement with said drive gear to a second position;

(iii) a quick turn mechanism rotatably connected to said second end of said drive rod and operably associated with said torque guide for moving said torque guide between said first and second positions, said quick turn mechanism of said operating assembly comprising:

a. a grip housing having an internal wall defining an internal cavity and a pair of spaced apart keys connected to said internal wall and extending into said cavity;

b. a direction actuator mounted within said internal cavity of said grip housing, said direction actuator being connected to said second end of said drive rod and having a pair of spaced apart keyways constructed and arranged to slidably engage said spaced apart keys of said grip housing to permit said direction actuator to move within said internal cavity of said grip housing between first and second positions, said direction actuator including a convex cam surface; and c. a locking member disposed within said internal cavity of said grip housing, said locking member being operably associated with said direction actuator for moving said direction actuator between said first and second positions upon rotation of said grip housing, said locking member including a concave cam surface, said concave cam surface being in engagement with said convex cam surface of said direction actuator; and (iv) a biasing spring connected to said drive rod for urging said torque guide into engagement with said drive gear.

7. The wrench as defined in claim 6 in which said torque guide includes a shoulder constructed and arranged to engage said drive gear in a manner to prevent rotation of said drive gear.

8. The wrench as defined in claim 7 in which said torque guide includes a gear engaging surface that is so constructed and arranged to engage said drive gear in a manner to permit rotation of said drive gear.

9. A wrench for rotating a socket comprising:

(a) a housing including a head portion and a handle portion, said head portion having an inner peripheral wall defining an internal cavity, a first set of drive teeth circumscribing said inner peripheral wall of said head portion and a second set of transversely spaced apart drive teeth circumscribing said inner peripheral wall of said head portion;

(b) a drive gear disposed within said internal cavity of said head portion of said housing, said drive gear connected to and spanning said first and second sets of transversely spaced apart drive teeth;

(c) a socket engaging drive member connected to said drive gear and extending outwardly from said head portion of said housing;

(d) first and second transversely spaced apart opposition gears disposed within said internal cavity of said head portion of said housing, said first and second transversely spaced apart opposition gears being disposed between said drive gear and said first and second sets of transversely spaced apart drive teeth, said first set of opposition gears being connected to said first set of transversely spaced apart drive teeth and said second set of opposition gears being connected to said second set of transversely spaced apart drive teeth; and (e) an operating assembly carried by said housing and operably associated with said drive gear, said operating assembly comprising:

(i) a drive rod having a first end and a second end;

(ii) a torque guide connected to said first end of said drive rod, said torque guide being movable from a first position in engagement with said drive gear to a second position in engagement with said drive gear; and (iii) a quick turn mechanism rotatably connected to said second end of said drive rod and operably associated with said torque guide for moving said torque guide between said first and second positions, said quick turn mechanism comprising:

a. a grip housing having an internal wall defining an internal cavity and a pair of spaced apart keys connected to said internal wall and extending into said cavity;

b. a direction actuator mounted within said internal cavity of said grip housing, said direction actuator being connected to said second end of said drive rod and having a pair of spaced apart keyways constructed and arranged to slidably engage said spaced apart keys of said grip housing to permit said direction actuator to move within said internal cavity of said grip housing between first and second positions; and c. a locking member disposed within said internal cavity of said grip housing, said locking member being operably associated with said direction actuator for moving said direction actuator between said first and second positions upon rotation of said grip housing.

10. The wrench as defined in claim 9 in which said operating mechanism further includes a biasing spring connected to said drive rod for urging said torque guide into engagement with said drive gear.

11. The wrench as defined in claim 10 in which said torque guide includes a shoulder constructed and arranged to engage said drive gear in a manner to prevent rotation of said drive gear.

* * * * *